US007400738B2

(12) United States Patent
Niederdränk et al.

(10) Patent No.: US 7,400,738 B2
(45) Date of Patent: Jul. 15, 2008

(54) ACOUSTIC MODULE FOR A HEARING AID DEVICE

(75) Inventors: Torsten Niederdränk, Erlangen (DE); Tom Weidner, Erlangen (DE); Christian Weistenhöfer, Bubenreuth (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 698 days.

(21) Appl. No.: 10/603,026

(22) Filed: Jun. 24, 2003

(65) Prior Publication Data

US 2004/0057592 A1 Mar. 25, 2004

(30) Foreign Application Priority Data

Jun. 27, 2002 (DE) ..... 102 28 826

(51) Int. Cl.
*H04R 25/00* (2006.01)

(52) U.S. Cl. ..... 381/318; 381/317; 381/312; 381/390

(58) Field of Classification Search ..... 381/318, 381/317, 312, 390
See application file for complete search history.

(56) References Cited

U.S. PATENT DOCUMENTS

| | | | | |
|---|---|---|---|---|
| 4,525,856 | A | 6/1985 | Admiraal et al. | |
| 5,195,139 | A * | 3/1993 | Gauthier | 381/322 |
| 5,204,917 | A | 4/1993 | Arndt et al. | |
| 5,276,739 | A | 1/1994 | Krokstad et al. | |
| 5,796,848 | A * | 8/1998 | Martin | 381/320 |
| 5,881,159 | A * | 3/1999 | Aceti et al. | 381/328 |
| 6,069,963 | A | 5/2000 | Martin et al. | |
| 6,466,678 | B1 * | 10/2002 | Killion et al. | 381/314 |
| 6,768,801 | B1 * | 7/2004 | Wagner et al. | 381/312 |
| 2003/0070868 | A1 * | 4/2003 | Kolpe et al. | 181/135 |
| 2003/0133579 | A1 * | 7/2003 | Danielsen et al. | 381/96 |
| 2005/0163331 | A1 * | 7/2005 | Gao et al. | 381/93 |

FOREIGN PATENT DOCUMENTS

| | | |
|---|---|---|
| DE | 35 02 178 | 8/1985 |
| DE | 37 23 809 | 1/1989 |
| DE | 198 52 758 | 5/2000 |
| DE | 199 08 194 | 7/2000 |
| EP | 0 250 679 | 1/1988 |
| WO | WO 95/22879 | 8/1995 |

* cited by examiner

*Primary Examiner*—Lincoln Donovan
*Assistant Examiner*—Forrest Phillips
(74) *Attorney, Agent, or Firm*—Schiff Hardin LLP

(57) ABSTRACT

An acoustic module for a hearing aid device has at least one microphone and at least one earphone (acoustic output transducer) combined together as a unit, the unit including a signal-processing unit for feedback suppression that is connected with the microphone and the earphone. Feedback signal portions are removed from the microphone signal by the signal-processing unit. The acoustic module places acousto-mechanical components within a unitary component, with acousto-mechanical characteristics that can be measured and included in the signal processing for feedback suppression.

28 Claims, 2 Drawing Sheets

ACOUSTIC MODULE FOR A HEARING AID DEVICE

BACKGROUND OF THE INVENTION

1. Field of the Invention

The present invention concerns an acoustic module for a hearing aid device of the type having a unit with at least one microphone and at least one earphone.

2. Description of the Prior Art

An acoustic module of this type is known from German OS 35 02 178 A1 wherein an acquisition part is described that has a section for the acquisition of noise changes, in particular from an earphone and a microphone, respectively. The sections are soundproofed in order to shield the microphone from the airborne sound emitted by the earphone.

A hearing aid worn behind the ear is known from German OS 37 23 809 that is divided into two housing segments. The first housing segment has a microphone, an earphone, and an amplifier circuit. The second segment has a battery compartment.

A modular-designed hearing aid device is known from U.S. Pat. No. 5,204,917 has a microphone module, a speaker module, an amplifier module, and a battery module.

A microphone system is known from German OS 198 52 758 that is designed in the form of a module and is attached to a mounting capable of being rotated and pivoted, that is mounted in a hearing aid housing. The microphone system can be oriented for improving the directional characteristic, for example, toward a speaker.

A microphone module is known from German OS 196 35 229 in which the microphones are provided with a common sound channel. This improves the protection of the microphone from dirt, simplifies the arrangement of the operating components, and enables an effective shielding with consistently good directional effect of the microphone module.

An HdO hearing aid device is known from German OS 199 08 194 that enables directional hearing.

A hearing aid with a shielding against radiofrequency electromagnetic waves is known from German OS 195 45 760.

The design of a hearing aid device is generally selected such that microphone and earphone are situated in the hearing aid device as far from each other as possible, such that they are decoupled from one other in terms of vibration.

SUMMARY OF THE INVENTION

An object of the invention is to simplify the design of a hearing aid device, as well as its production, and the minimization of feedback therein.

This object is inventively achieved in an acoustic module of the type initially described, wherein the unit that is connected to the microphone and the earphone has a signal-processing unit for suppressing feedback.

This object is also achieved in accordance with the invention in a hearing aid device with a hearing aid signal-processing unit that has a recess for the incorporation of an acoustic module as described above, as well as a hearing aid device with a hearing aid signal-processing unit and with such an acoustic module.

An acoustic module according to the invention has the advantage that the signal processing for the reduction of feedback can already be implemented in the acoustic module by means of a signal-processing unit.

An acoustic module according to the invention is used with a hearing aid device that includes a hearing aid signal processor. The hearing aid signal processor differs from the signal-processing unit for feedback suppression in the acoustic module. As its name implies, the former accomplishes the signal processing common in a hearing aid device, for example, corresponding to a hearing loss of a hearing aid device user. The latter attempts to reduce feedback in the acoustic module.

An advantage of the use of an acoustic module that has one or more microphones and one or more acoustic output transducers (earphones) is that the overall construction of the hearing aid device is simplified by the acoustic module, and correspondingly smaller housing sizes and shorter sound channels of the hearing aid device are possible.

A further advantage of a common unit for microphones and earphones is that, the unit can be optimized for a special geometric, acousto-mechanical arrangement of the assembled microphone and loudspeaker because of lower feedback. The feedback can be, for example, evoked by structure-borne sound coupling or by acoustic feedback through the air between loudspeaker and microphone.

There also is the advantage that the feedback of the unit that would not be minimized, or would only slightly be minimized, can be measured. This measured feedback characteristic of the acoustic module can be, for example, electronically saved in the acoustic module or in the hearing aid device, and then used to compensate the feedback by means of the signal-processing unit and an algorithm, similar to a feedback compensation circuit. Another possible algorithm suppresses the feedback without resorting to a measured feedback characteristic, in that it adopts as an evolutionary algorithm (neural network) toward a feedback-free signal.

Furthermore, an acoustic module according to the invention offers the advantageous possibility of an independent development and production independent of the final-product hearing aid device. The finished acoustic module can be subsequently accepted into the development or production process of the hearing aid device.

In one embodiment, the unit has a carrier structure with the microphone and earphone connected thereto. This has the advantage that this common carrier structure can effect notable vibration dampening, for example using reinforcing materials or particularly appropriate materials.

In another embodiment, the unit has a housing. This offers the possibility for isolation of the unit from external noise vibrations, as well as enabling vibrations in the housing to be damped.

In another embodiment, the unit has a directional microphone. In a further embodiment, the unit has at least two microphones that form a directional microphone system. The latter two embodiments enable the advantageous property of directional sensitivity to be integrated into the unit.

In a another embodiment, damping materials are incorporated into the unit of the acoustic module. These can either be attached to the carrier structure or the housing, and suppress vibrations from microphone or earphone at the source or in their transmission.

In a further embodiment, the acoustic module has an attachment arrangement that enables attachment of the unit to the hearing aid device. This is advantageous since a standardized attachment of the unit can be used in various hearing aid devices.

In a one embodiment, the unit is firmly inserted in the hearing aid device, such that the vibration coupling of the unit with the hearing aid device can ensue in a known manner, and thus be included in the feedback characteristics.

In another embodiment, the unit is removably inserted in the hearing aid device such that it can be detached. This has the advantage that the acoustic module can be easily exchanged for the purpose of servicing. Regardless of whether the unit is rigidly or removably connectable to the hearing aid device, connections are employed that suppress rigid-body vibrations of the unit, and the possibility to use relatively simple mechanical or electrical connection technology, such as plug connections, flexible circuit boards, or MID technology (a technology for producing three-dimensional injection-molded units, Molded Interconnect Devices) that require no rubber parts. The possibility to avoid moldable materials such as rubber parts improves the long-term stability of the unit and thus reduces the development, service, and productions costs, and the time expenditure therewith.

In a preferred embodiment plug contacts are used to connect the unit to the hearing aid signal-processing unit. This has the advantage that disadvantageous stranded connectors are not needed for production and service. An additional advantage is that an algorithm for reducing feedback can be implemented by means of the hearing aid signal-processing unit.

In a further embodiment a device that shields the unit from electromagnetic fields is provided. The compact design of the acoustic module and its unit simplify this shielding device.

The invention can be used in all known hearing aid types, for example in hearing aids worn behind the ear, hearing aids worn in the ear, implantable hearing aids, hearing aid systems or pocket hearing aids.

DESCRIPTION OF THE PREFERRED EMBODIMENTS

Figure 1:
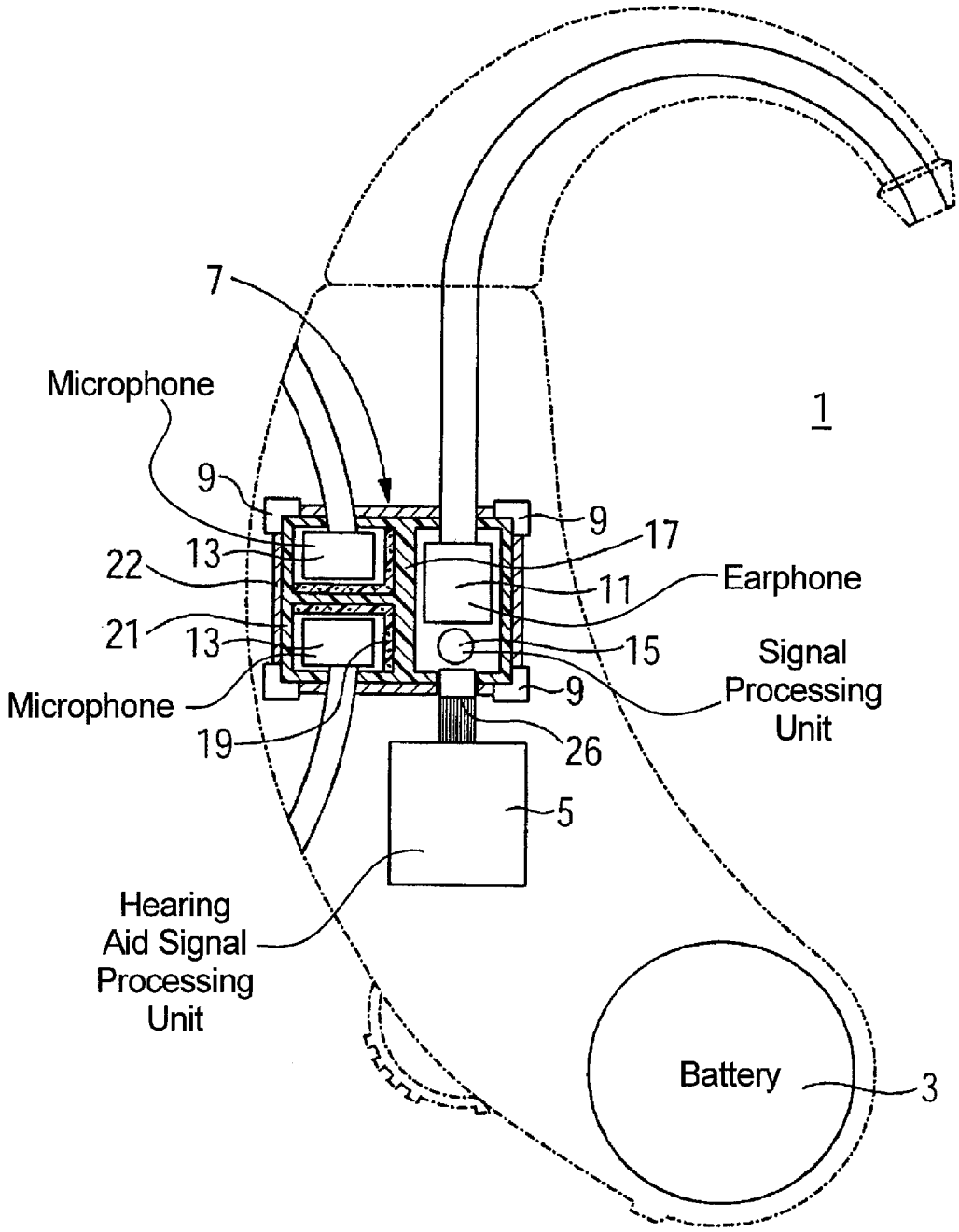
FIG. 1 illustrates interior components, partly in section, in a hearing aid device in which an acoustic module unit is used in accordance with the invention.

A hearing aid device is shown in FIG. 1 that has a battery 3 for energy supply to the hearing aid device, a hearing aid, a signal-processing unit 5, and a unit 7 of an acoustic module. The unit 7 is located in a recess of the hearing aid device 1 that is designed to accept the acoustic module. The unit 7 is incorporated fixed in form in the recess and is isolated from vibration with damping materials 9. Alternatively, this attachment can be implemented with the capability of being attached and detached. The unit 7 has an acoustic output transducer (earphone) 11, two microphones 13, and a signal-processing unit 15. The earphone 11, the microphone 13, and the signal-processing unit 15 are attached in a carrier structure 17. Damping materials that are mounted in the partially reinforced carrier structure 17 damp the structure-borne sound vibrations that are generated inside the unit 7 by the earphone 11 and prevent a connection to the microphones 13. The unit 7 is contained in a housing 21 that is provided with a shielding 22 from electromagnetic fields.

If the microphones 13 (that can be implemented as a directional microphone system 24 (FIG. 3), or as a directional microphone 25 (FIG. 2)) acquire signals, these are transduced into electronic signals and freed, by the signal-processing unit 15 using an algorithm, of feedback signal portions that, for example, feed back from the earphone 11 to the microphone 13 via the housing of the unit 7 or the housing of the hearing aid device 1 (structure-borne noise) or via the air (acoustic noise). The signal-processing unit 15 is connected with plug contacts 26. These plug contacts form the connection for the hearing aid signal-processing unit 5. The hearing aid signal-processing unit 5 alters the electronic signal dependent on the hearing impairment of the hearing aid device user and sends this electronic signal to the earphone 11 (output transducer) that emits these signals in acoustic form to the hearing aid user. The algorithm for freeing the signals of feedback components also can be implemented in the hearing aid device-processing unit 5. The algorithms used can be, for example, evolutionary algorithms or algorithms that operate on the signal to remove a feedback characteristic of the unit 7 or hearing aid device 1.

Figure 2:
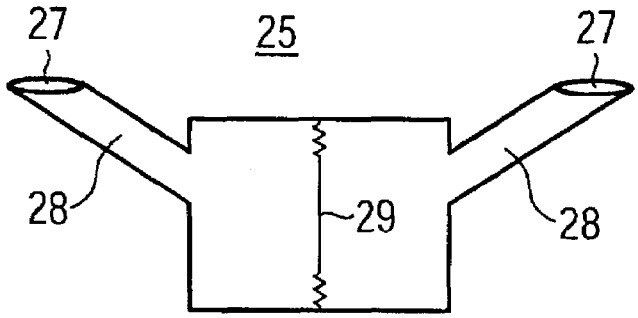
FIG. 2 illustrates a gradient-directional microphone for use in accordance with the invention.

FIG. 2 shows the schematic design of a directional microphone 25. This is an example of an arrangement known as gradient directional microphones and has two sound inputs 27, from which the sound is fed via two sound channels 28 to the opposite sides of a membrane 29. The movement of the membrane 29 is determined by the difference of the momentary acoustic pressure on both sides of the membrane 29. The movement is thus dependent on the difference between the two possible paths between a sound source and the membrane 29, which is determined by the position of the sound source relative to the sound inputs 27.

Figure 3:
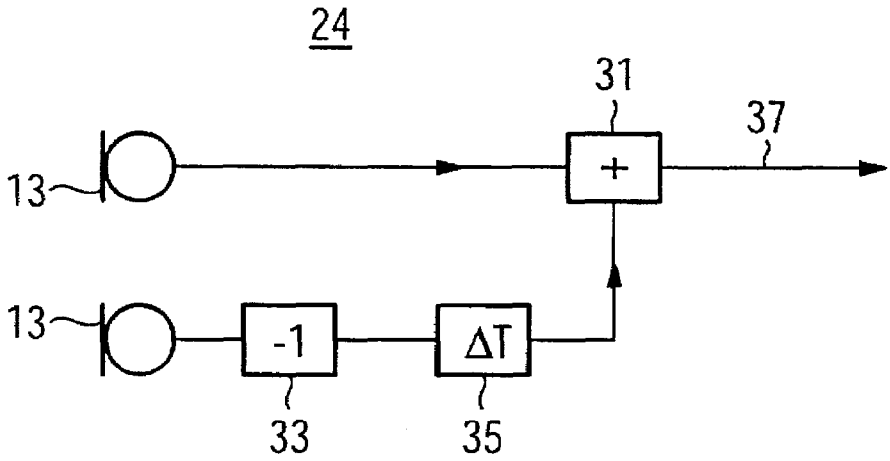
FIG. 3 is a block diagram of a directional microphone system made from two microphones that are electronically interconnected with each other for use in accordance with the invention.

FIG. 3 shows a block diagram for the operating mode of a directional microphone system 24. The signals from two non-directional microphones 13 are combined via an adder 31, with one of the two signals being inverted by an inverter 33 and delayed by a delay unit 35 preceding the adder 31. The signal available at the signal output 37 then depends on the position of the sound source relative to the non-directional microphones 13.

As noted above, either of the microphone arrangements shown in FIGS. 2 and 3 can be used in the unit 7.

Although modifications and changes may be suggested by those skilled in the art, it is the intention of the inventors to embody within the patent warranted hereon all changes and modifications as reasonably and properly come within the scope of their contribution to the art.

We claim:

1. An acoustic module for a hearing aid device comprising a unit adapted for insertion as a module in the hearing aid device, said unit comprising at least one mechanical component, and electrical components, consisting of a pre-combined acousto-electrical transducer and electro-acoustical transducer and a module signal processing unit, said acoustic-electrical transducer and said acousto-electrical transducer being pre-combined by said at least one mechanical component, said acousto-electrical transducer and said electro-acoustical transducer having feedback associated therewith that is substantially fixed due to the acousto-electrical transducer and the electro-acoustical transducer being pre-combined, and said module signal-processing unit being pre-programmed dependent on said substantially fixed feedback, only to suppress said substantially fixed feedback.

2. An acoustic module as claimed in claim 1 wherein said at least one mechanical component comprises a carrier structure to which said acousto-electrical transducer and said electro-acoustical transducer are connected.

3. An acoustic module as claimed in claim 1 wherein said at least one mechanical component comprises a housing containing said acousto-electrical transducer, said electro-acoustical transducer and said module signal-processing unit.

4. An acoustic module as claimed in claim 1 wherein said acousto-electrical transducer is a directional microphone.

5. An acoustic module as claimed in claim 1 wherein said acousto-electrical transducer is formed by a plurality of microphones.

6. An acoustic module as claimed in claim 5 wherein said plurality of microphones forms a directional microphone system.

7. An acoustic module as claimed in claim 1 wherein said unit comprises vibration-damping materials.

8. An acoustic module as claimed in claim 1 further comprising an attachment arrangement adapted to attach said unit in said hearing aid device.

9. An acoustic module as claimed in claim 8 wherein said attachment arrangement is adapted to fixedly connect said unit in said hearing aid device.

10. An acoustic module as claimed in claim 8 wherein said attachment arrangement is adapted to detachably connect said unit in said hearing aid device.

11. An acoustic module as claimed in claim 8 wherein said attachment arrangement is adapted to damp vibrations between said unit and said hearing aid device.

12. An acoustic module as claimed in claim 1 wherein said hearing aid device comprises a hearing aid signal-processing unit, and wherein said unit is adapted for connection to said hearing aid signal-processing unit.

13. An acoustic module as claimed in claim 12 wherein said unit comprises plug contacts adapted to connect said unit to said hearing aid signal-processing unit.

14. An acoustic module as claimed in claim 1 wherein said unit comprises shielding against external electromagnetic fields.

15. A hearing aid device comprising:

a module comprising at least one mechanical component, and electrical components, consisting of a pre-combined acousto-electrical transducer and electro-acoustical transducer and a module signal processor, said acoustic-electrical transducer and said acousto-electrical transducer being pre-combined by said at least one mechanical component said acousto-electrical transducer and said electro-acoustical transducer having feedback associated therewith that is substantially fixed due to the acousto-electrical transducer and the electro-acoustical transducer being pre-combined, and said module signal processing unit being pre-programmed dependent on said substantially fixed feedback, only to suppress said substantially fixed feed back;

a hearing aid signal processor outside of said module; and a hearing aid housing having a recess therein in which said module is received, said module being mechanically and electrically connected to said hearing aid signal processor in said hearing aid housing and said hearing aid signal processor processing signals between said acousto-electrical transducer and said electro-acoustical transducer dependent on a hearing impairment of a user of the hearing aid device.

16. A hearing aid device as claimed in claim 15 wherein said hearing aid housing comprises a mounting for receiving said module.

17. A hearing aid device as claimed in claim 15 wherein said comprises at least one mechanical component, and electrical components, consisting of a carrier structure to which said acousto-electrical transducer and said electro-acoustical transducer are connected.

18. A hearing aid device as claimed in claim 15 wherein said comprises at least one mechanical component, and electrical components, consisting of a module housing containing said acousto-electrical transducer, said electro-acoustical transducer and said module signal-processing unit.

19. A hearing aid device as claimed in claim 15 wherein said acousto-electrical transducer is a directional microphone.

20. A hearing aid device as claimed in claim 15 wherein said acousto-electrical transducer is formed by a plurality of microphones.

21. A hearing aid device as claimed in claim 20 wherein said plurality of microphones forms a directional microphone system.

22. A hearing aid device as claimed in claim 15 wherein said module comprises vibration-damping materials.

23. A hearing aid device as claimed in claim 15 further comprising an attachment arrangement to attach said module in said recess.

24. A hearing aid device as claimed in claim 23 wherein said attachment arrangement is adapted to fixedly connect said module in said recess.

25. A hearing aid device as claimed in claim 23 wherein said attachment arrangement is adapted to detachably connect said module in said recess.

26. A hearing aid device as claimed in claim 23 wherein said attachment arrangement damps vibrations between said module and said hearing aid signal processor.

27. A hearing aid device as claimed in claim 15 wherein said module comprises plug contacts connecting said module to said hearing aid signal processor.

28. A hearing aid device as claimed in claim 15 wherein said module comprises shielding against external electromagnetic fields.

* * * * *